US005724821A

United States Patent [19]

Lord et al.

[11] Patent Number: 5,724,821

[45] Date of Patent: Mar. 10, 1998

[54] COMPRESSOR OIL PRESSURE CONTROL METHOD

[75] Inventors: Richard G. Lord, Tullahoma, Tenn.; Kenneth J. Nieva, Baldwinsville, N.Y.

[73] Assignee: Carrier Corporation, Syracuse, N.Y.

[21] Appl. No.: 671,970

[22] Filed: Jun. 28, 1996

[51] Int. Cl.[6] ..... F25B 31/00; F25B 43/02

[52] U.S. Cl. ..... 62/84; 62/222; 62/473; 62/193

[58] Field of Search ..... 62/193, 473, DIG. 17, 62/222, 84

[56] References Cited

U.S. PATENT DOCUMENTS 5,067,326 11/1991 Alsenz ..... 62/193
5,134,856 8/1992 Pillis et al. ..... 62/193

*Primary Examiner*—William E. Wayner

[57] ABSTRACT

The present invention is a method for controlling oil lubricant pressure of a screw type compressor in an air conditioning system. In response to a low oil pressure condition, evaporator pressure is lowered to increase the pressure differential across a compressor, to thereby bring about an increase in oil pressure. Evaporator pressure can be lowered by decreasing the maximum operating pressure of the evaporator, and by throttling an expansion valve by the amount required to lower the evaporator pressure in accordance with the reduced maximum operating setpoint.

12 Claims, 3 Drawing Sheets

COMPRESSOR OIL PRESSURE CONTROL METHOD

BACKGROUND OF THE INVENTION

1. Field of the Invention

The present invention relates to air conditioner chiller system in general, and in particular to a method for controlling compressor oil pressure in an air conditioner chiller system.

2. Background of the Prior Art

Oil is commonly used to lubricate screw compressors of an air conditioner system. To the end that a minimally satisfactory amount of oil is supported in a compressor, the oil pressure of a compressor must be sufficient to support this minimally satisfactory amount of oil lubricant. If the oil pressure falls below a pressure necessary to support a minimally satisfactory amount of lubricant, compressor bearing failure, screw rotor failure or gear failure may result. Oil pressure of a compressor is dependant on the pressure differential across a compressor, which depends on the air conditioning system condenser pressure and the evaporator pressure. Specifically, oil pressure depends on the difference between the condenser pressure and the evaporator pressure. When outside ambient air temperature decreases, the condenser saturation temperature and pressure decrease giving rise to the possibility that oil pressure may fall below a minimally satisfactory level.

Existing methodologies for controlling oil pressure attempt to maintain oil pressure above a certain level by way of routines which disable components or processes which otherwise would operate to cool the condenser. In one prior art method, condenser fans are turned off in response to a low oil pressure condition to increase the temperature and pressure of a condenser, to thereby increase the pressure differential, between the condenser and evaporator and therefore the compressor oil pressure. In another routine, water flow to the condenser is throttled to increase the condenser temperature and pressure, and therefore the pressure differential between the condenser and evaporator.

Unfortunately, the methods of the prior art tend to be slow and during some startup and transient conditions, are not sufficient to maintain pressure above a minimally satisfactory level. Consequently, units controlled according to such methods are susceptible to nuisance shutdowns.

SUMMARY OF THE INVENTION

According to its major aspects and broadly stated, the present invention is a method for maintaining a minimally satisfactory amount of lubricant in a compressor of an air conditioning system. Oil pressure may fall below a minimally satisfactory level during periods of low ambient air temperature at which time operation pressure is lowered.

A minimally satisfactory lubricant amount in a compressor is maintained by maintaining a minimally satisfactory oil pressure in a compressor for supporting the lubricant. The available oil pressure is dependant on the pressure differential across a compressor which is equal to the difference between the condenser pressure and the evaporator pressure. For some economized chiller systems, available oil pressure is dependant on the difference between the condenser pressure and the economizer pressure.

According to the present invention, evaporator pressure is lowered in response to the condition that oil pressure falls below a minimally satisfactory level. Thereby, the pressure differential between the condenser and evaporator, (or economizer, in the case of an economized system) along with the available oil pressure, is increased. Lowering of the evaporator pressure is effected most preferably by throttling of the system expansion valve. The amount of expansion valve throttling can be made dependant on the pressure differential.

The invention may be implemented by configuring a controller which controls an electronic expansion valve, the expansion valve being in fluid communication with the evaporator. Received by the controller are sensor signals indicative of the condenser pressure and the evaporator pressure, and economizer pressure in the case of an economizer system. The controller continuously determines oil pressure based on these input signals. If oil pressure drops below a predetermined minimally satisfactory pressure, the controller throttles the expansion valve by an amount effective to eliminate the low oil pressure condition.

BRIEF DESCRIPTION OF THE DRAWINGS

In the drawings, wherein like numerals are used to indicate the same elements throughout the views.

DETAILED DESCRIPTION OF THE PREFERRED EMBODIMENTS

Figure 1:
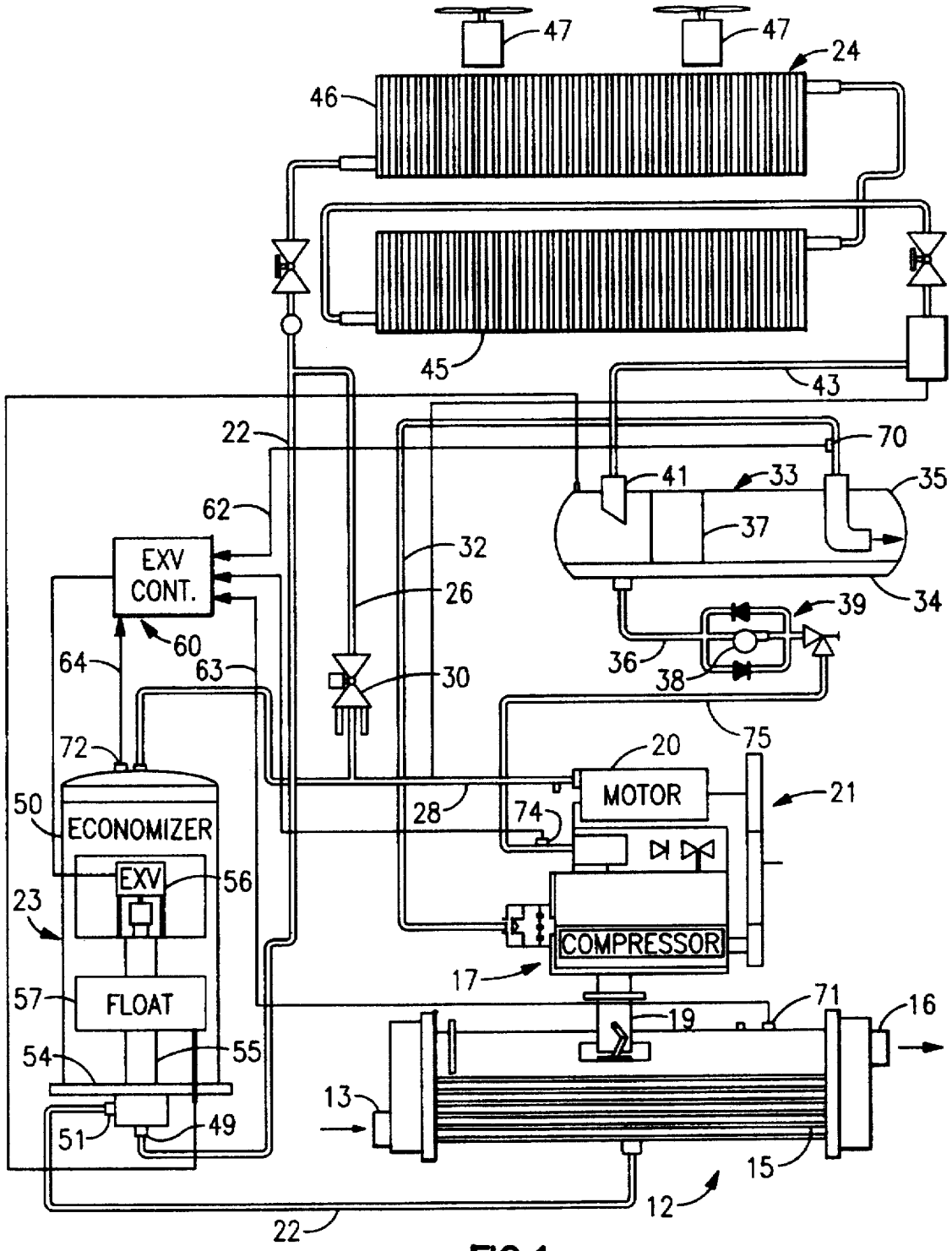
FIG. 1 shows a schematic diagram of a chiller system in which the present invention may be integrated.

An example of one type of air conditioning chiller system in which the present invention may be integrated is shown in FIG. 1. Chiller system 10 is typically employed to chill water or other suitable liquids in the system evaporator 12. Water enters the cooler through an inlet port 13 and is circulated through a series of heat exchanger tubes 15 before the water is discharged through an exit port 16. The cooler is flooded with liquid refrigerant at a low temperature which absorbs heat from the water being circulated through the heat exchanger tubes. Accordingly, refrigerant gas is driven off and supplied to the system compressor 17.

The compressor 17 employed in the present invention is a screw compressor. The suction side of the compressor is connected directly to the refrigerant outlet of the cooler through means of a flanged coupling 19. The rotors of the compressor are connected to a drive motor 20 via a gear train 21. As in the case of most screw compressors, lubricating oil is distributed to the rotors and the bearings of the machine and is compressed, along with the refrigerant, to a relatively high temperature and pressure.

As will be explained in greater detail below, the present chiller system is equipped with an economizer 23 located in the liquid line 22 connecting the condenser section 24 and the evaporator section 12. Systems of the type shown in FIG. 1 are commonly referred to as economized systems because of there inclusion of economizer 23. In the economizer, a portion of the refrigerant moving between the condenser and the evaporator is reduced to a pressure somewhere intermediate the operating pressures of the condenser and the evaporator. The flash gas that is generated is fed back to the compressor through the compressor motor so that it absorbs heat from the motor to provide cooling to the motor. The vapor leaves the motor and is introduced into the compressor flow at an intermediate point along the compressor flow path.

There is an additional provision provided in the present system for motor cooling. Liquid refrigerant is shunted from the liquid line 22 directly to the flash gas inlet line 28 to the compressor motor by shunt line 26. In the event the motor becomes overly warm, the condition is sensed by the system controller and a solenoid valve 30 in the shunt line is opened and liquid refrigerant supplements the economizer flash gas in providing motor cooling. When a desired motor operating temperature is once again attained, the solenoid valve is closed by the system controller.

In the compressor, the refrigerant vapor is driven to a desired high temperature and pressure. The discharge gas from the compressor is directed via a discharge line 32 to an oil separator 33 wherein the oil contained in the high pressure gas is removed from the refrigerant vapor. The compressor discharge gas enters the top of the separator shell 34 and is directed against the end wall 35 of the shell so that a good deal of the oil separates out of gas and is collected in the bottom of the tank. The remaining compressor gas then flows through a wire mesh screen 37 where the remaining oil is separated and allowed to drain to the bottom of the tank. An oil return line 36 located in the bottom of the tank which returns the oil collected in the tank to the motor under system pressure without the aid of a pump. A small prelube pump 38 is connected in the oil return line by means of a check valve network 39 to insure that sufficient oil pressure is provided to the system at start up. The pump is activated for about twenty seconds prior to starting of the compressor and as soon as the system pressure differential reaches a desired level, the pump is shut down.

Refrigerant vapor leaves the oil separator at the outlet 41 located at the top of the tank and is piped via vapor line 43 to the inlet of the system condenser 24. The condenser section in the present embodiment of the invention includes two fan coil units 45 and 46 that are mounted adjacent to each other in parallel flow relationship. The condenser is an air cooled system wherein a plurality of fans 47—47 are employed to draw ambient air over the heat exchanger fins of the fan coil units. Refrigerant moving through the circuits is reduced to a liquid with the heat of condensation is rejected into the air stream moving over the fan coils.

Liquid refrigerant residing in the condenser is piped to the bottom inlet 49 of the economizer 23. The economizer is housed within a vertically disposed steel sheet 50 that is attached to a base 54 containing the refrigerant inlet port 49 and outlet port 51. An interior standpipe 55 routes the incoming refrigerant to an electronically controlled expansion valve (EXV) 56 which is mounted in the upper section of the upright economizer shell. The EXV serves to rapidly expand the incoming liquid refrigerant to a lower intermediate pressure whereupon the vapor produced by the expansion collects in the upper part of the shell chamber while the liquid phase is collected in the bottom of the shell chamber. As noted above, the vapor developed in the top of the shell is passed back to the compressor through the compressor motor by means of gas inlet line 28.

The economizer operates at an intermediate pressure somewhere between the condenser pressure and the evaporator pressure. The liquid that is collected in the bottom of the economizer is throttled a second time through adjustable metering orifices located in a stand pipe 50. Although not shown, a metering sleeve is slidably contained within the standpipe which is arranged to be adjustably positioned by a float 57 to control the opening and closing of metering orifices in response to the liquid level in the chamber. The second throttling process further lowers the pressure and temperature of the liquid refrigerant which causes the refrigerant to flash to a two phase fluid. The two phase refrigerant is then delivered into the cooler via liquid line 22. The fluid floods the chilled water tubes and because of its lower temperature, absorbs heat from the water to lower the water temperature to a desired operating level.

A liquid level sensor is provided in the evaporator cooler which is adapted to send a control signal to the EXV controller 60, which in turn controls the flow of liquid refrigerant to the cooler to maintain the liquid level in the cooler at a desired level.

Figure 2:
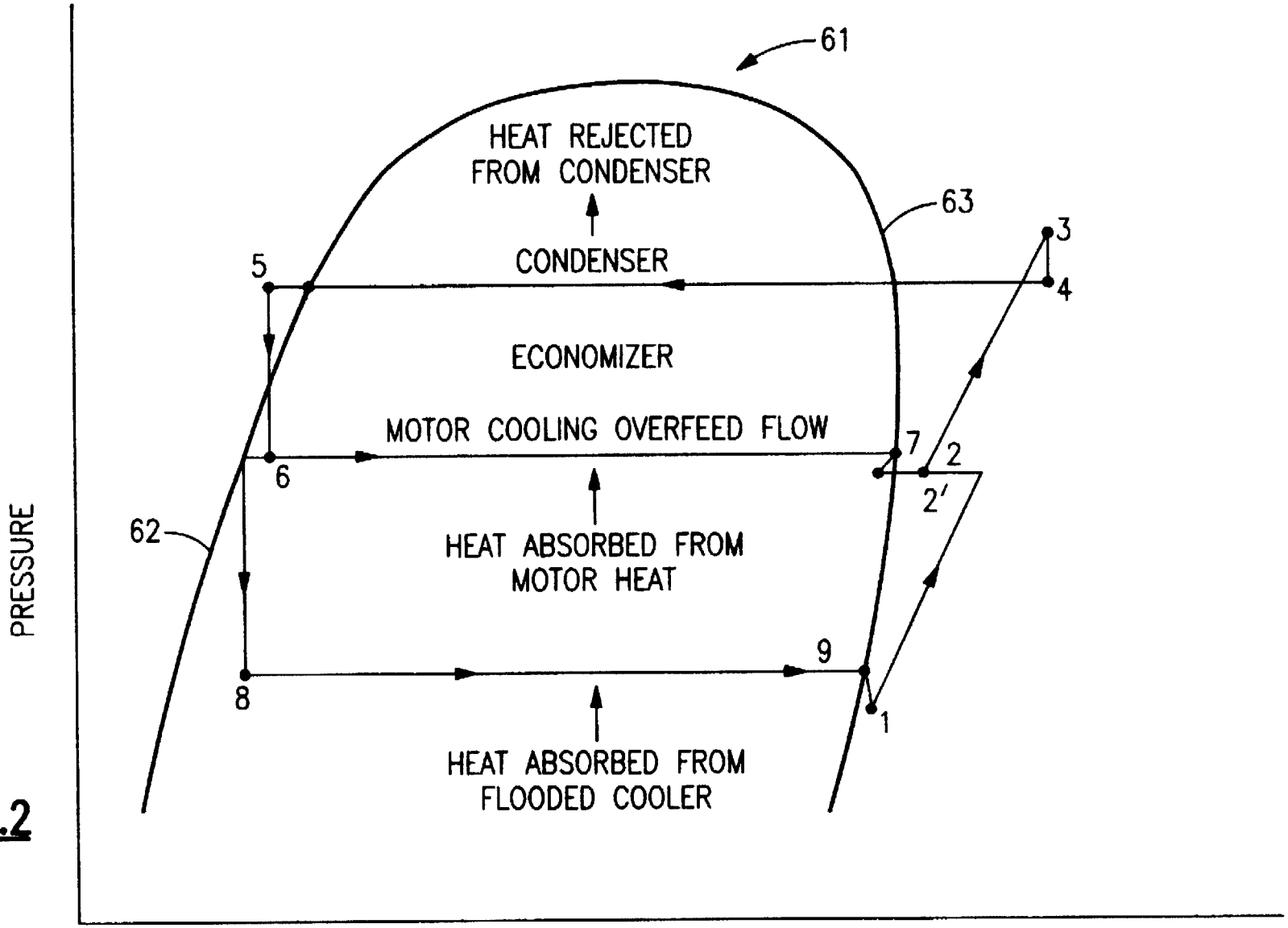
FIG. 2 shows an enthalphy diagram for a chiller system illustrating phase changes in a refrigerant moving through the system.

The thermodynamic cycle of the present chiller system will be explained in further detail with reference to FIG. 2 which shows the phase changes in the refrigerant as it moves through the refrigeration loop. The refrigerant cycle diagram 61 is shown wherein pressure is plotted against enthalpy. The liquid line 62 is depicted on the left hand side of the curve while the vapor line 63 is on the right hand side of the curve. Initially, vapor enters the suction side of the compressor from the evaporator at state point 1 and is compressed to a higher pressure shown at state point 2. Vapor from the economizer is introduced into the compressor at state point 7 where it is mixed with the in-process vapor causing a slight decrease in energy to state point 2. The compressor continues to produce work on the combined vapor until the vapor reaches discharge pressure at state point 3.

The compressed vapor enters the oil separator at state point 3 wherein the oil is removed from the refrigerant and returned to the compressor. Due to the oil separation procedure, the pressure of the refrigerant vapor drops slightly to state point 4 at the entrance to the condenser.

In the condenser, the refrigerant is reduced isobarically from a superheated vapor to a liquid at state point 5 and the heat of condensation is rejected into the air passing through the condenser coils. A water cooled condenser can also be used. Liquid refrigerant enters the economizer at state point 5 and undergoes a first adiabatic expansion to state point 6 as it passes through the EXV. As a result, some of the refrigerant is vaporized and returned to the compressor through the compressor motor where it provides some motor cooling. The flash gas enters the compressor at state point 7 where it mixes in with the process vapor at state point 2.

The remaining liquid in the economizer is throttled through float controlled throttling orifices and is delivered to the entrance of the evaporator cooler at state point 8. Here the low pressure liquid vapor absorbs heat from the fluid being chilled and is transformed to a vapor at state point 9. The refrigerant vapor at state point 9 is exposed to the suction side of the compressor to complete the cycle.

In the present invention, a method is employed for maintaining a minimally satisfactory amount of lubricant in a compressor 17. Compressor 17 contains a satisfactory amount of lubricant when there is a satisfactory oil pressure differential across compressor 17.

Accordingly, a minimally satisfactory amount of lubricant in a compressor is maintained by maintaining a minimally satisfactory oil pressure in a compressor 17 for supporting the lubricant. Oil pressure is dependant on the pressure differential across a compressor, which is equal to the difference between the condenser pressure and the evaporator pressure for non-economized systems. For economized systems of the type shown in FIG. 1, oil pressure is equal to the difference in pressure between the condenser and economizer pressure. The minimal satisfactory oil pressure will vary depending on the particular compressor selected.

According to the present invention, the suction pressure of evaporator, or cooler 12, is lowered in response to the condition that oil pressure falls below a minimally satisfactory level. Thereby, the pressure differential between the condenser and evaporator, (or economizer) and therefore the oil pressure, is increased. Lowering of the evaporator pressure is effected most preferably by throttling of system expansion valve 56. Expansion valve 56 is throttled an appropriate amount, in general, by decreasing a maximum operating pressure (MOP) setpoint for evaporator 13. Controller 60 for controlling EXV will throttle EXV 56 by an amount necessary to lower the evaporator pressure to the MOP value based on a feedback signal from evaporator 13 indicative of evaporator pressure. This feedback signal may be provided, for example, by pressure transducer 71. When throttled, the internal flow area of EXV 56 is decreased.

The invention may be implemented by appropriately configuring controller 60 for controlling expansion valve 56. Controller 60 may comprise a microprocessor based control system. Received by controller 60 are sensor signals carried by inputs 62, 63 and 64 indicative of the condenser pressure, evaporator pressure, and economizer pressure, respectively. Condenser (discharge) pressure, evaporator (suction) pressure, and economizer pressure may be sensed by pressure transducers 70, 71, and 72, respectively. In addition, oil pressure switch 74 for measuring absolute oil pressure (as distingished from oil pressure differential) may be disposed in oil line 75. Temperature sensors may also be employed to indirectly detect pressure in condenser 24, evaporator 12 and economizer 23. The controller continuously determines oil pressure differential based on these input signals. If oil pressure differential drops below a predetermined minimally satisfactory pressure, the controller throttles expansion valve 56 by an amount effective to remove the low oil pressure problem. In one embodiment, the maximum evaporation operating pressure (MOP) setpoint for evaporator 12 is lowered in response to the sensing of a loss of satisfactory oil pressure. EXV 56 is then throttled by an amount necessary to lower the evaporator pressure to the decreased MOP setpoint.

Figure 3:
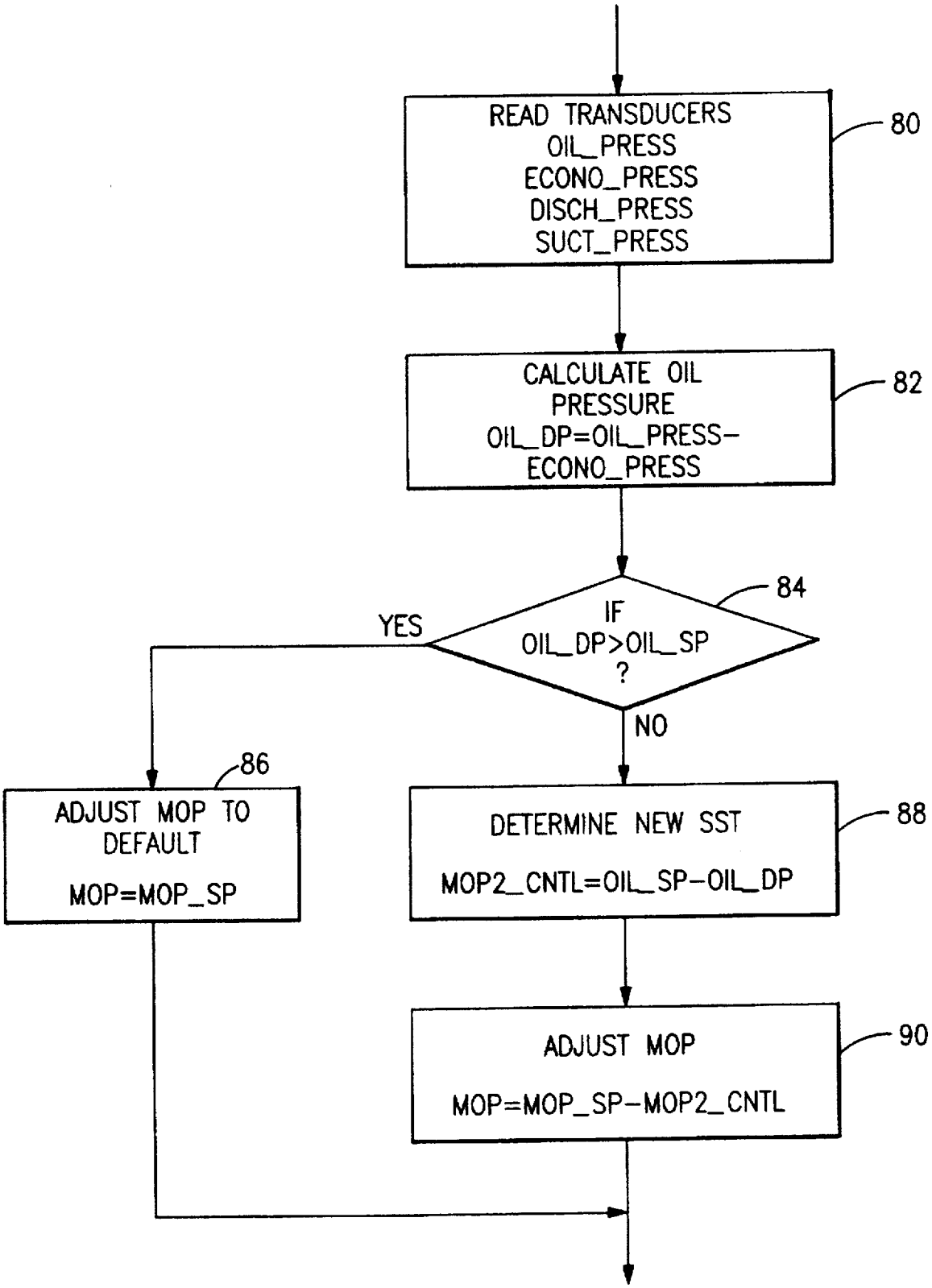
FIG. 3 is a flow diagram illustrating one preferred implementation of the invention.

A flow diagram illustrating steps carried out by a controller configured according to the invention is shown in FIG. 3. At step 80 controller 60 reads the output from pressure sensors 70, 71, 72 and 74 indicative, respectively, of discharge pressure, suction pressure, economizer pressure, and absolute oil pressure. Some or all of these measurements may be utilized in controlling system 10. At step 82 controller 60 determines oil pressure based on the readings from pressure sensors 74 and 72 indicative of oil pressure and economizer pressure.

In the example illustrated in FIG. 3, oil pressure differential calculated in step 82 will be absolute oil pressure as measured from transducer 74 minus the economizer pressure. In the case of a non-economized chiller, oil pressure in step 82 could be calculated by subtracting evaporator (suction) pressure from oil pressure.

As stated elsewhere, oil pressure differential could be determined by subtracting evaporator (or economizer) pressure from condenser (discharge) temperature). When discharge pressure is used to calculate oil pressure differential, a loss factor should be subtracted from the difference between dicharge and evaporator (or economizer) pressure in determining oil pressure differential. The loss factor is attributable to pressure drops through the oil supply line, through the oil filter, and through the oil solenoid valve. In most systems, this loss factor is in the range of from about 5 PSI to about 10 PSI.

At step 84, controller 60 determines whether the value for oil pressure differential determined at step 82, $OIL_{DP}$ is greater than a minimally satisfactory oil pressure differential, $OIL_{SP}$. If $OIL_{DP}$ is greater than $OIL_{SP}$, then there is no low oil pressure problem, and at step 86 the cooler maximum operating pressure is set to $MOP_{SP}$, the default pressure setpoint which would determine pressure in evaporator 12 in the absence of the control routine of the present invention.

If controller determines at step 84 that $OIL_{DP}$ is less than a minimally satisfactory amount, then a low oil pressure condition exists. If a low oil pressure condition exists, then controller 60 effects a decrease in cooler pressure to increase the oil pressure level.

At step 88 controller 60 determines the pressure difference between $OIL_{DP}$ and $OIL_{SP}$, the amount by which the minimally satisfactory oil pressure differential exceeds the determined oil pressure differential. The maximum oil pressure setpoint is adjusted at step 90 by a pressure equal to the difference between the minimal satisfactory and determined oil pressures, and EXV 56 is accordingly throttled by an amount necessary to effect the requested cooler MOP adjustment.

While the present invention has been explained with reference to a number of specific embodiments, it will be understood that the spirit and scope of the present invention should be determined with reference to the appended claims.

What is claimed is:

1. A method for controlling oil pressure of a compressor in an air conditioning system of the type wherein the oil pressure is dependent on the pressure difference between the suction and discharge of the compressor, said system having an evaporator, said method comprising the steps of:

determining oil pressure differential in said compressor;

comparing said determined oil pressure differential to a predetermined minimal oil pressure differential; and on the condition that said determined oil pressure differential is less than said minimum oil pressure differential reducing an operating pressure of said evaporator to increase said oil pressure.

2. The method of claim 1, wherein said system comprises an expansion valve and wherein said reducing step includes the step of throttling said expansion valve to reduce said operating pressure.

3. The method of claim 1, wherein said system comprises an expansion valve and wherein said reducing step includes the steps of:

decreasing a maximum operating pressure setpoint for said evaporator; and throttling said expansion valve by an amount effective to reduce an operating pressure of said evaporator in accordance with said maximum operating pressure setpoint.

4. The method of claim 1, wherein said comparing step includes the steps of calculating a difference pressure indicating the magnitude of a difference between said determined and minimum satisfactory pressure, and wherein said reducing step includes the step of reducing said pressure setpoint by an amount dependant on said difference pressure.

5. The method of claim 1, wherein said comparing step includes the step of calculating a difference pressure equal to the magnitude of a difference between said determined and minimum satisfactory pressure, and wherein said reducing step includes the step of reducing said pressure setpoint by an amount equal to said difference pressure.

6. The method of claim 1, wherein said system comprises a condenser and wherein said determining step includes the steps of:

sensing an operating pressure of said condenser;

detecting an operating pressure of said evaporator; and finding a difference between said condenser and evaporator operating pressures.

7. The method of claim 6, wherein said determining step further includes the step of subtracting a loss factor from said difference.

8. The method of claim 1, wherein said system comprises a condenser and an economizer and wherein said determining step includes the steps of:

sensing an operating pressure of said condenser;

detecting an operating pressure of said economizer; and finding a difference between said condenser and economizer pressure.

9. The method of claim 8, wherein said determining step further includes the step of subtracting a loss factor from said difference.

10. The method of claim 1, further comprising the step, prior to said comparing step, of selecting a minimally satisfactory oil pressure.

11. The method of claim 1, wherein said system comprises an oil line and an economizer and wherein said determining step includes the steps of:

sensing an oil pressure in said oil line;

detecting an operating pressure of said economizer; and finding a difference between said oil pressure and said economizer pressure.

12. The method of claim 1, wherein said system comprises an oil line and an evaporator and wherein said determining step includes the steps of:

sensing an oil pressure in said oil line;

detecting an operating pressure of said evaporator; and finding a difference between said oil pressure and said evaporator pressure.

* * * * *